US009272480B2

(12) United States Patent
Little

(10) Patent No.: US 9,272,480 B2
(45) Date of Patent: Mar. 1, 2016

(54) METHOD OF MANUFACTURING A VALVE BAG

(75) Inventor: Richard Anthony Rudd Little, Whitchurch (GB)

(73) Assignee: Jenton International Limited, Hampshire (GB)

( * ) Notice: Subject to any disclaimer, the term of this patent is extended or adjusted under 35 U.S.C. 154(b) by 784 days.

(21) Appl. No.: 13/529,871

(22) Filed: Jun. 21, 2012

(65) Prior Publication Data

US 2013/0023394 A1 Jan. 24, 2013

(30) Foreign Application Priority Data

Jun. 22, 2011 (GB) ..... 1110567.3

(51) Int. Cl.
*B31B 1/64* (2006.01)
*B31B 19/84* (2006.01)

(52) U.S. Cl.
CPC ..... *B31B 19/84* (2013.01); *B31B 2219/9067* (2013.01)

(58) Field of Classification Search
CPC ..... B31B 1/64; B31B 2219/9067; B31B 2219/9051; B31B 2201/9085; B65D 31/14
USPC ..... 493/189, 254, 162, 177, 87, 213; 383/44, 45, 103, 105, 106
See application file for complete search history.

(56) References Cited

U.S. PATENT DOCUMENTS 3,807,118 A * 4/1974 Pike ..... 53/410
4,557,377 A * 12/1985 Maloney ..... 206/219
2008/0124007 A1 5/2008 Thomasset

FOREIGN PATENT DOCUMENTS

| | | | |
|---|---|---|---|
| EP | 1375124 | A1 | 1/2004 |
| FR | 1348079 | A | 1/1964 |
| GB | 2447611 | | 7/2011 |
| JP | 01240451 | A | 9/1989 |
| JP | 10000706 | A | 1/1998 |

* cited by examiner

*Primary Examiner* — Robert Long
*Assistant Examiner* — Xavier A Madison
(74) *Attorney, Agent, or Firm* — Sandra P. Thomson; Slater Hersey & Lieberman, LLP

(57) ABSTRACT

Methods of manufacturing a valve bag are disclosed. First and second webs of valve material, such as heat sealable plastic film, are combined to create a combined web of valve material, and a sealing process is applied thereto to define valve portions. The combined web of valve material includes a plurality of valve strip portions, each including a valve portion. Then first and second bag sections, which may be on a first and second side respectively of a web of folded bag material, or on a first web and second web of bag material respectively, are dispensed with the combined web of valve material positioned in between, and brought together to form a combined web of valve bag material. A sealing process is applied to the combined web of valve bag material, forming a valve bag section. The bag section is then separated from the remainder of the combined web of valve bag material to form an individual valve bag.

12 Claims, 15 Drawing Sheets

METHOD OF MANUFACTURING A VALVE BAG

This United States Utility Application claims priority to United Kingdom Patent Application Serial No.: 1110567.3 filed on Jun. 22, 2011 and entitled "Method of Manufacturing a Valve Bag", which is commonly-owned and incorporated herein in its entirety by reference.

FIELD OF THE SUBJECT MATTER

The field of the subject matter relates to a method of manufacturing a valve bag. More specifically, but not exclusively, a method of manufacturing a valve bag on side-weld or pouch making machines is disclosed.

BACKGROUND

GB-A 2447611 describes a valve bag, and a method of manufacturing the same. The valve bag is manufactured by dispensing a first and second web of material, each having a 'valve' and an 'open' side; creating a combined web by contacting a lower side of the first web with an upper side of the second web; sealing the combined web together along a sealing line adjacent the valve side, the sealing process defining a valve portion; separating the first and second web at the open side and folding outwardly until a section of a lower side of the first web contacts an upper side of the second web; sealing together the contacting sections of the first and second web; and separating adjacent bag sections.

This valve bag was an improvement over its predecessors and their respective methods of manufacture. That is, it used conventional sealing and folding machines and allowed the manufacturer to vary the size and quantity of bags produced, such that the small valve bags for holding small items, such as nuts and bolts, were possible. Its predecessors were far more expensive to manufacture, such that only valve bags for larger quantities of products were economically viable.

It is therefore desirable to alleviate the above problem.

SUMMARY OF THE SUBJECT MATTER

Methods of forming a valve bag are disclosed and include: dispensing a first web of valve material and a second web of valve material, the first and second webs of valve material both having an upper side and a lower side, the valve material being plastic film; creating a combined web of valve material by contacting the lower side of the first web of valve material with the upper side of the second web of valve material, the combined web of valve material being formed of a plurality of valve strip portions; applying a sealing process to the combined web of valve material such that the first web of valve material is sealed to the second web of valve material, the sealing process defining at least one valve portion in each valve strip portion; introducing the combined web of valve material between a first bag section and a second bag section, the first and second bag sections each having an upper side and a lower side; creating a combined web of valve bag material, by contacting the lower side of the first bag section with the upper side of the first web of valve material, and by contacting the upper side of the second bag section with the lower side of the second web of valve material, the combined web of valve bag material being formed of a plurality of valve bag sections, each containing a valve strip portion; applying a sealing process to the combined web of valve bag material such that the first bag section is sealed to the first web of valve material and the second bag section is sealed to the second web of valve material, the sealing process defining each valve bag section; and separating adjacent valve bag sections into individual valve bags.

Additional methods of forming a valve bag include: dispensing a first bag section and a second bag section, each having an upper side and a lower side; dispensing a combined web of valve material, the valve material being plastic film, such that the combined web of valve material is positioned between the first bag section and the second bag section, wherein the combined web of valve material has an upper side and a lower side and is formed of a plurality of valve strip portions each including a valve portion; creating a combined web of valve bag material, by contacting the upper side of the combined web of valve material with the lower side of the first bag section, and by contacting the lower side of the combined web of valve material with the upper side of the second bag section, the combined web of valve bag material being formed of a plurality of valve bag sections, each containing a valve strip portion; applying a sealing process to the combined web of valve bag material, the sealing process defining each valve bag section; and separating adjacent valve bag sections into individual valve bags.

DETAILED DESCRIPTION

Figure 1:
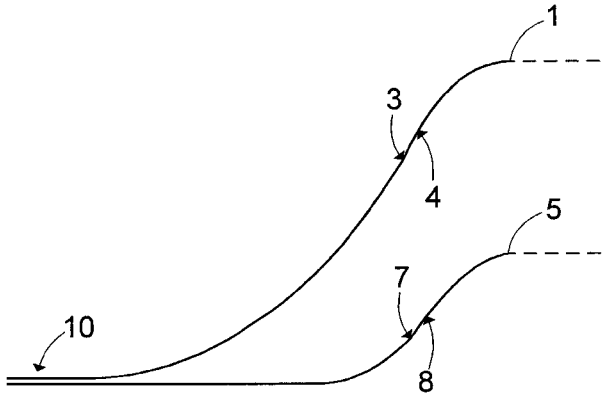
FIG. 1 is a side view of a first and second web of valve material being dispensed according to a first stage of a first embodiment of a contemplated method.

According to a first embodiment, there is provided a method of forming a valve bag comprising the steps of dispensing a first web of valve material and a second web of valve material, the first and second webs of valve material both having an upper side and a lower side, the valve material being plastic film; creating a combined web of valve material by contacting the lower side of the first web of valve material with the upper side of the second web of valve material, the combined web of valve material being formed of a plurality of valve strip portions; applying a sealing process to the combined web of valve material such that the first web of valve material is sealed to the second web of valve material, the sealing process defining at least one valve portion in each valve strip portion; introducing the combined web of valve material between a first bag section and a second bag section, the first and second bag sections each having an upper side and a lower side; creating a combined web of valve bag material, by contacting the lower side of the first bag section with the upper side of the first web of valve material, and by contacting the upper side of the second bag section with the lower side of the second web of valve material, the combined web of valve bag material being formed of a plurality of valve bag sections, each containing a valve strip portion; applying a sealing process to the combined web of valve bag material such that the first bag section is sealed to the first web of valve material and the second bag section is sealed to the second web of valve material, the sealing process defining each valve bag section; and separating adjacent valve bag sections into individual valve bags.

One benefit of contemplated methods is that the manufacturer only requires a sealing machine in order to manufacture the valve bag, i.e. the expensive folding machine is not required. The method is suitable for use with both forms of side-weld bags, i.e. a single web of folded bag material (having a first bag section on a first side of the fold and a second bag section on a second side of the fold), and with two webs of bag material (having a first bag section on the first web and a second bag section on the second web).

Furthermore, contemplated methods are better suited to production lines for producing 'pouches'. That is, pouches are generally produced on co-extruded/multi-layered films which may not be outwardly folded by the method according to the prior art, or at least the valve bag is not self-sealing once produced. However, in contemplated methods, the folding step has been omitted, making it easier to produce pouches.

According to a second embodiment, there is provided a method of forming a valve bag comprising the steps of: dispensing a first bag section and a second bag section, each having an upper side and a lower side; dispensing a combined web of valve material, the valve material being plastic film, such that the combined web of valve material is positioned between the first bag section and the second bag section, wherein the combined web of valve material has an upper side and a lower side and is formed of a plurality of valve strip portions each including a valve portion; creating a combined web of valve bag material, by contacting the upper side of the combined web of valve material with the lower side of the first bag section, and by contacting the lower side of the combined web of valve material with the upper side of the second bag section, the combined web of valve bag material being formed of a plurality of valve bag sections, each containing a valve strip portion; applying a sealing process to the combined web of valve bag material, the sealing process defining each valve bag section; and separating adjacent valve bag sections into individual valve bags.

Therefore, a converter (i.e. bag maker) may acquire the combined web of valve material, including valve strip portions, and apply it to their existing production line. Therefore, the converter also does not need to modify their production line to include an expensive folding frame.

The skilled reader will understand that it would require very little modification of existing production lines in order to incorporate the introduction of the combined web of valve material, including the valve strip portions, between a first and second bag section. The manufacturer may then produce the valve bags by combining the web of valve material with the first and second bag sections, and apply a sealing process.

Preferably, each bag section has a first side and a second side, wherein the step of applying a sealing process to the combined web of valve bag material includes an initial step of in-line edge sealing the upper side of the first web of valve material to the lower side of the first bag section and in-line edge sealing the lower side of the second web of valve material to the upper side of the second bag section, along the first and second sides thereof, and a subsequent step of cross-sealing the combined web of valve bag material.

The first and second bag sections may be part of a web of folded bag material, wherein the combined web of valve material is introduced at a header end of the web of folded bag material.

Alternatively, the first and second bag sections are part of a first web of bag material and a second web of bag material respectively, wherein the combined web of valve material is introduced at a header end of the first and second webs of bag material, and the step of applying a sealing process to the combined web of valve bag material may include sealing along a footer end of the first and second webs of valve material.

Optionally, the valve material is different to the bag material. Therefore, the properties of each material may be optimized for the particular application.

Contemplated embodiments will now be described, by way of example, and with reference to the drawings. A method of a first contemplated embodiment will now be described with reference to FIGS. 1 to 7.

A first stage of the method is shown in FIG. 1. A first web 1 of plastic film has an upper side 3 and a lower side 4. Similarly, a second web 5 of plastic film has an upper side 7 and a lower side 8.

The first and second webs 1, 5 of plastic film are dispensed and brought together to form a combined web 10 of plastic film, such that the lower side 4 of the first web 1 contacts the upper side 7 of the second web 5.

Figure 2:
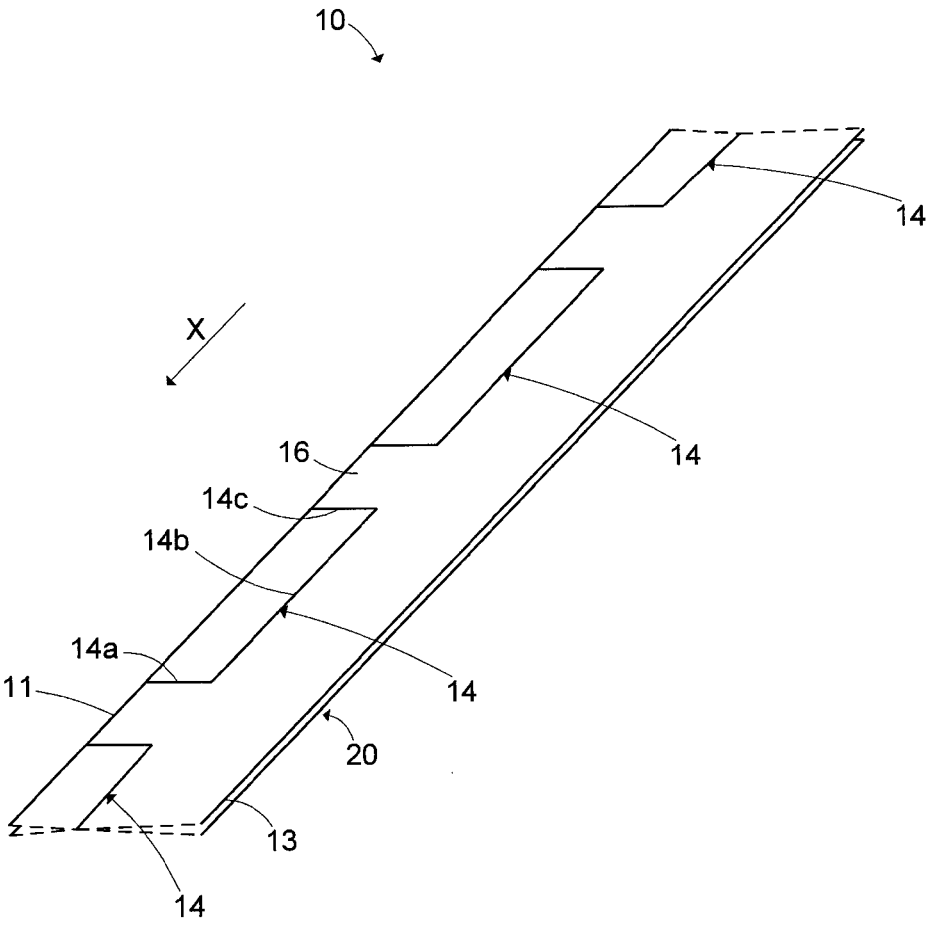
FIG. 2 is a perspective view of a combined web of valve material produced during the second stage of the embodiment of FIG. 1.

FIG. 2 illustrates the second stage of manufacture, wherein the combined web of plastic film 10 is conveyed along direction 'X' and passes through a sealing machine (not shown). The combined web of plastic film 10 has a valve side 11 and an open side 13.

The sealing machine applies a sealing process to the combined web of plastic film 10. A sealing line 14 is applied along a first perpendicular portion 14*a*, a parallel portion 14*b*, and a second perpendicular portion 14*c*. The first and second perpendicular portions 14*a*, 14*c* extend from the valve side 11 of the combined web of plastic film 10, along a minor axis thereof (i.e. perpendicular to direction 'X'), before joining the parallel portion 14*b*. The parallel portion 14*b* extends along the major axis of the combined web of plastic film 10 (i.e. parallel to direction 'X').

A valve portion 16 is defined between adjacent sealing lines 14, i.e. between the second perpendicular portion 14*c* of one sealing line 14 and the first sealing portion 14*a* of an adjacent sealing line 14.

Figure 3:
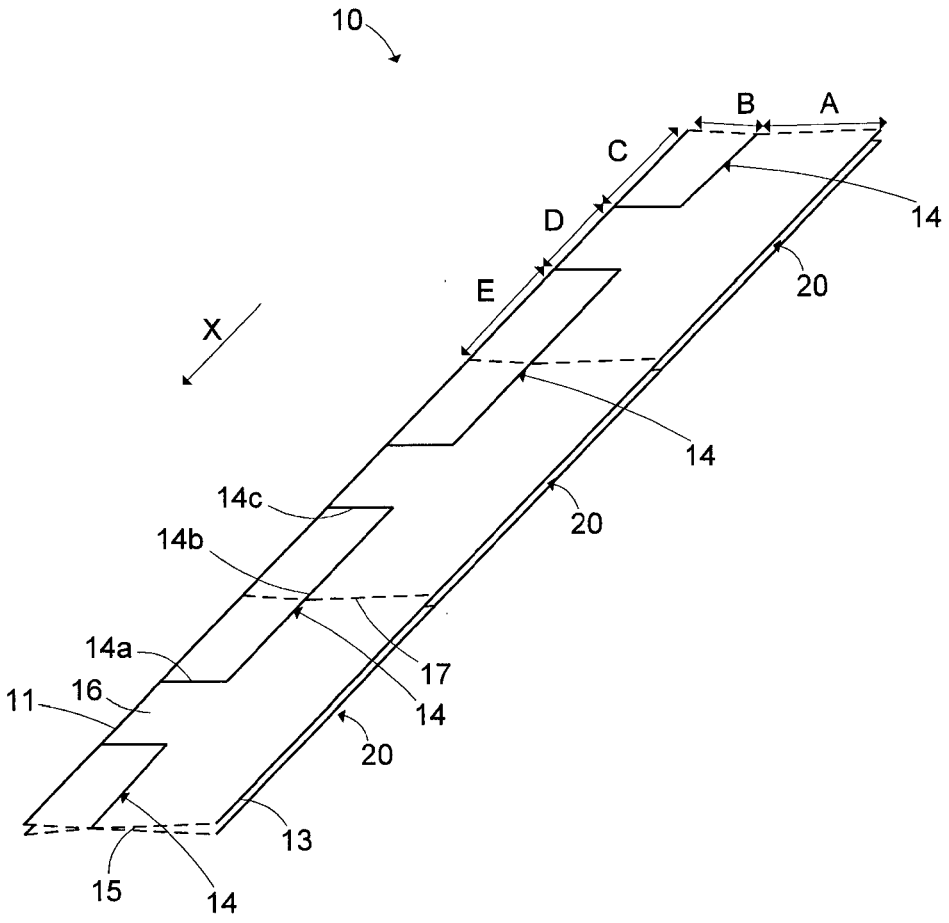
FIG. 3 is a perspective view of the combined web of valve material of FIG. 2, showing the valve strip portions.

FIG. 3 illustrates the combined web of plastic film 10 (hereinafter referred to as a "valve strip") including a plurality of valve strip portions 20. Each valve strip portion 20 has a notional top side 15 and notional bottom side 17, shown as dotted lines. The skilled reader will understand, by reading the following description that the notional sides 15, 17 are where a sealing process will eventually be applied, and are not physical modifications.

As shown in FIG. 3, the sealing line 14 defines distance A, which extends from the open side 13 of each valve strip portion 20 to the parallel portion 14*b*; distance B, which extends from the valve side 11 of each valve strip portion 20 to the parallel portion 14*b*; distance C, which extends from the bottom side 17 of each valve strip portion 20 to the first perpendicular portion 14*a*; distance D, which extends from the first perpendicular portion 14*a* to the second perpendicular portion 14*c*; and distance E, which extends from the second perpendicular portion 14*c* to the top side 15 of each valve strip portion 20. The skilled reader will understand that distance D is the width of a valve portion 16 of each valve strip portion 20. Furthermore, the skilled reader will understand that the distances A, B, C, D and E may be varied depending on a particular application. For example, if the valve bag is to be used with liquids, then the distance D should be made smaller. Alternatively, if the valve bag is to be used with discrete objects, then the distance D should be made relatively larger.

Figure 4:
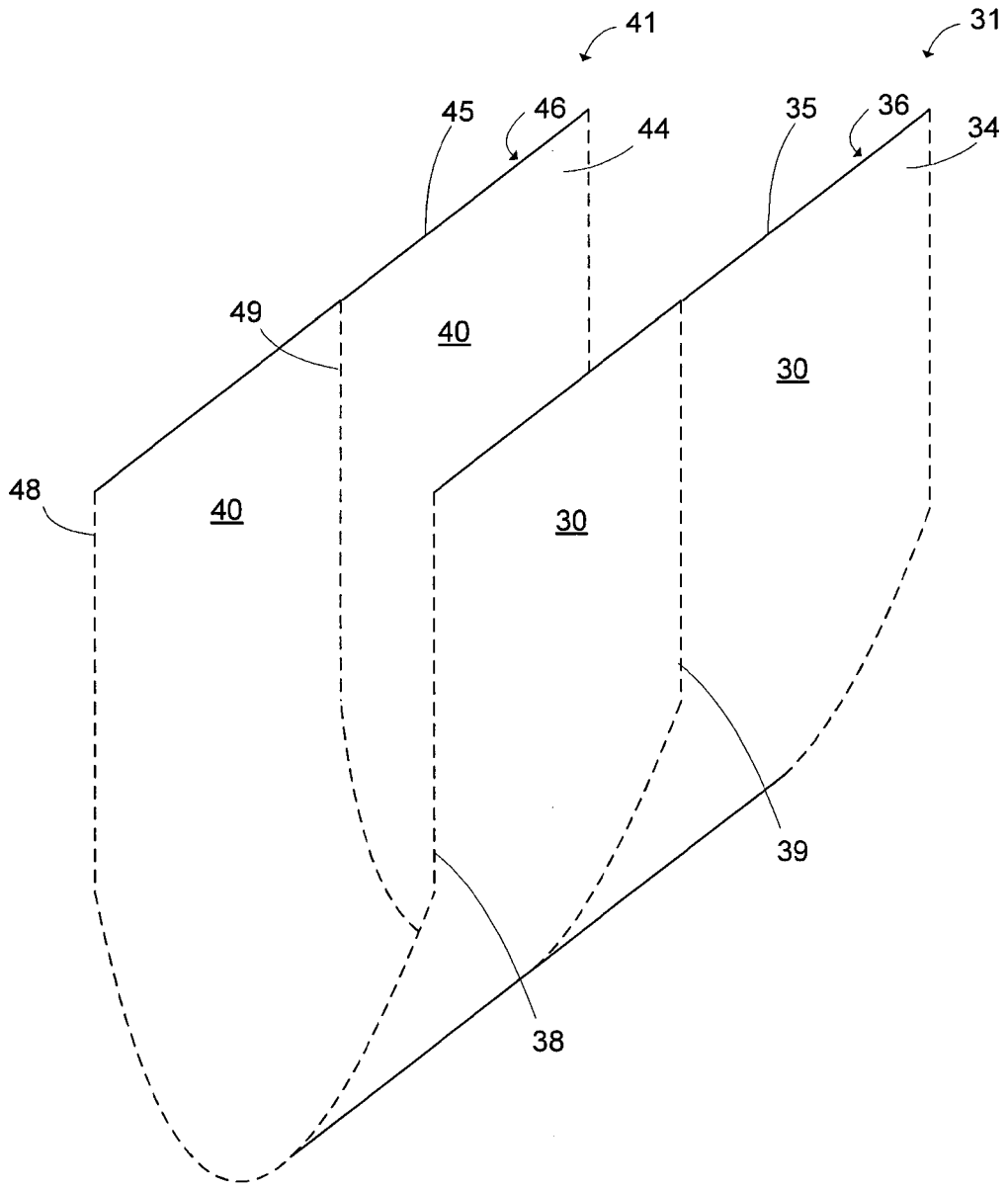
FIG. 4 is a perspective view of a web of folded bag material, dispensed during a third stage of the embodiment of FIG. 1.

FIG. 4 illustrates a third stage of manufacture, wherein a web of folded bag material (e.g. plastic film) is dispensed. The web of folded bag material has an open end (at a header of the bag) and a folded end (at a footer of the bag). The web of folded bag material has a first side 31 (i.e. a first side of the fold), having a first edge 35 at the open end and an upper face 34 and a lower face 36, and a second side 41 (i.e. a second side of the fold), having a second edge 45 at the open end and an upper face 44 and a lower face 46.

The first side 31 of the web of folded bag material has a plurality of first bag sections 30 defined thereon, each extending from the first edge 35 of the open end to the fold. Furthermore, the second side 31 of the folded bag has a plurality of second bag sections 40 defined thereon, each extending from the second edge 45 of the open end to the fold. The first and second bag sections 30, 40 both have a notional top side 38, 48 and a notional bottom side 39, 49 respectively.

Figure 5:
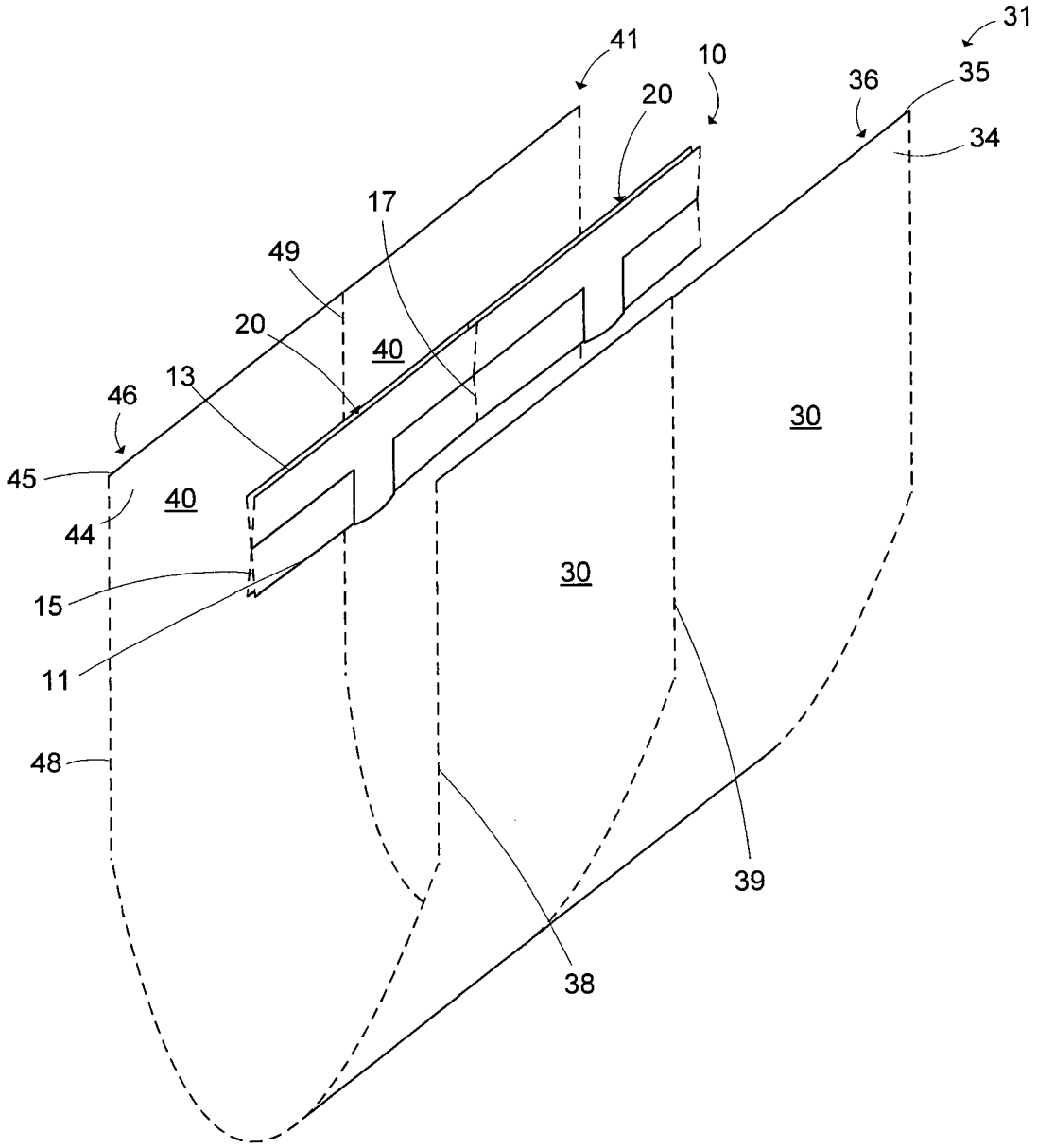
FIG. 5 is a perspective view of the combined web of valve material being introduced between a first and second side of the web of folded bag material, according to a fourth stage of the embodiment of FIG. 1.

FIG. 5 illustrates a fourth stage of manufacture, wherein the valve strip 10 is introduced between the first and second sides 31, 41 of the folded bag, such that a valve strip portion 20 aligns with a pair of bag sections 30, 40. That is, the top side 15 of each valve strip portion 20 is aligned with the top sides 38, 48 of each bag sections 30, 40; the bottom side 17 of each valve strip portion 20 is aligned with the bottom sides 39, 49 of the each bag section 30, 40; the open side 13 of each valve strip portion 20 is directed towards the first edges 35, 45 of the first and second bag sections 30, 40; and the valve side 11 of each valve strip portion 20 is directed towards the fold of the folded bag.

Figure 6:
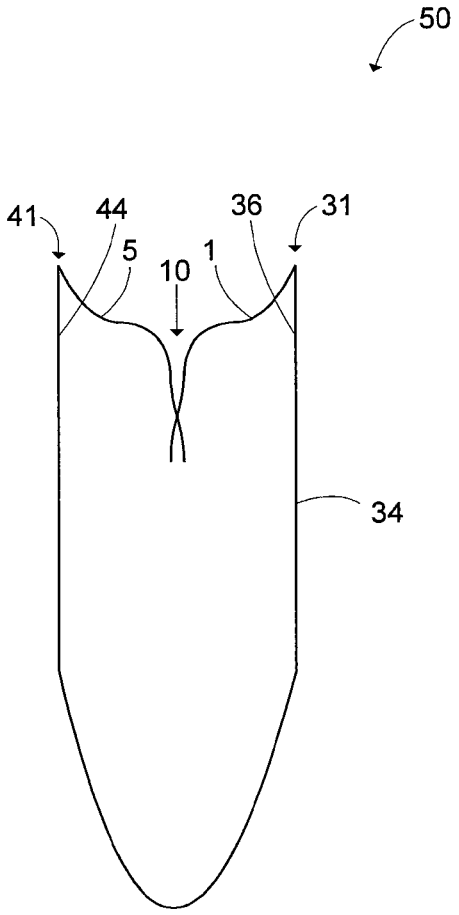
FIG. 6 is a side view of the combined web of valve material and the web of folded bag material, having been in-line edge sealed thereto according to a fifth stage of the embodiment of FIG. 1.

FIG. 6 illustrates the fifth stage of manufacture. The first web 1 of the plastic film 10 is brought into contact with the lower face 36 of the first side 31 of the web of folded bag material, and is sealed thereto at the top sides 15, 38, 48 and bottom sides 17, 39, 49. Furthermore, the second web 5 of the plastic film 10 is brought into contact with the upper face 44 of the second side 41 of the web of folded bag material, and is sealed thereto at the top sides 15, 38, 48 and bottom sides 17, 39, 49. This process is called in-line edge sealing, and creates the combined web 50 of valve bag material.

Figure 7:
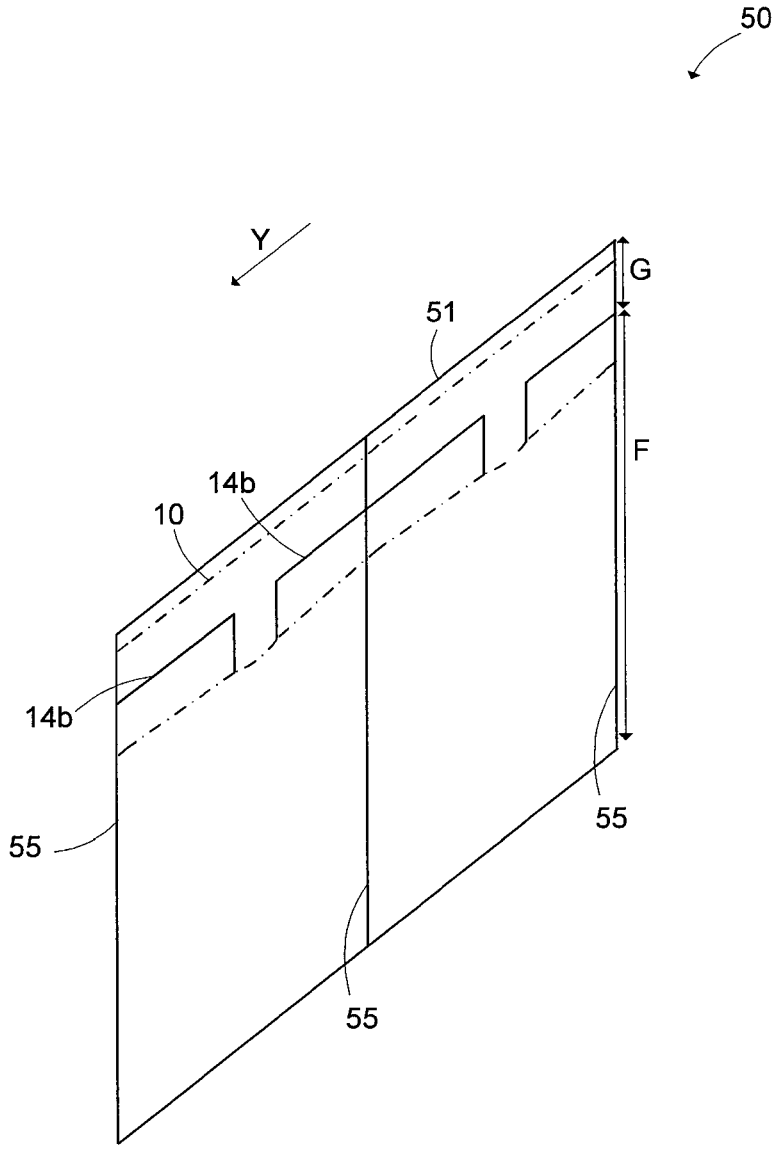
FIG. 7 is a perspective view of the combined web of valve bag material, having been cross-sealed according to a sixth stage of the embodiment of FIG. 1.

FIG. 7 illustrates the sixth stage of manufacture. The combined web 50 of valve bag material is conveyed along direction 'Y' and passes through a cross-sealing machine (not shown). The cross-sealer applies sealing lines 55 to the combined web of valve bag material, along the top and bottom sides 15, 17 of the valve strip 10 and the top and bottom sides 38, 39, 48, 49 of the first side 31 and second side 41 of the bag sections 30, 40 of the web of folded bag material. Thus, the valve strip 10 is sealed to the web of folded bag material, forming bag sections along its length. The bag sections may then be separated by a cutting machine (not shown).

FIG. 7 also shows distance G, which runs from a valve side 51 of the combined web 50 of valve bag material to the parallel portion 14*b* of the sealing line 14. The skilled reader will understand that this is the gusset length of the valve bag. Furthermore, FIG. 7 shows distance F, which runs from the parallel portion 14*b* of the sealing line 14 to the fold. The skilled reader will understand that these distances may be varied according to the particular application. In this embodiment, these distances may be varied during the in-line edge sealing phase detailed above.

FIGS. 8 to 12 illustrate the third to sixth stages of manufacture of a second contemplated embodiment. In this embodiment, a valve strip 10 is produced in the same manner as in the first embodiment. Like reference numerals have been used for like features.

Figure 8:
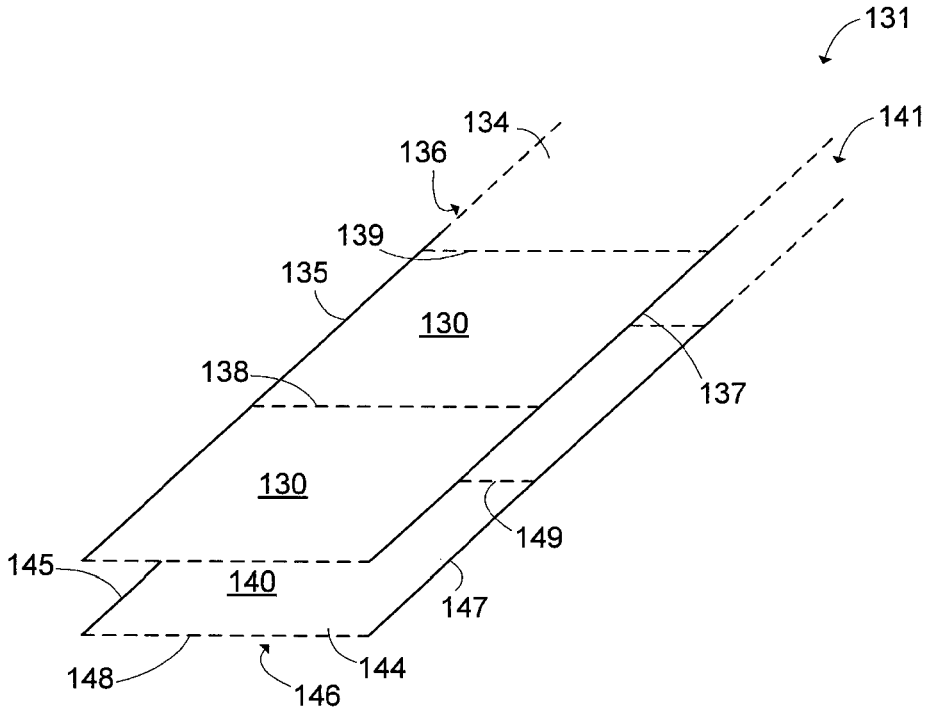
FIG. 8 is a perspective view of a first web of bag material and a second web of bag material according to a second embodiment of a contemplated method.

As shown in FIG. 8, a first web 131 of bag material (e.g. plastic film) and a second web 141 of bag material (e.g. plastic film) are dispensed. The first web 131 of bag material defines a plurality of first bag sections 130, each extending from a valve side 135 towards an open side 137 of the first web 131, having an upper side 134 and a lower side 136. Similarly, the second web 141 of bag material defines a plurality of second bag sections 140, each extending from a valve side 145 towards an open side 147 of the second web 141, having an upper side 144 and a lower side 146.

Figure 9:
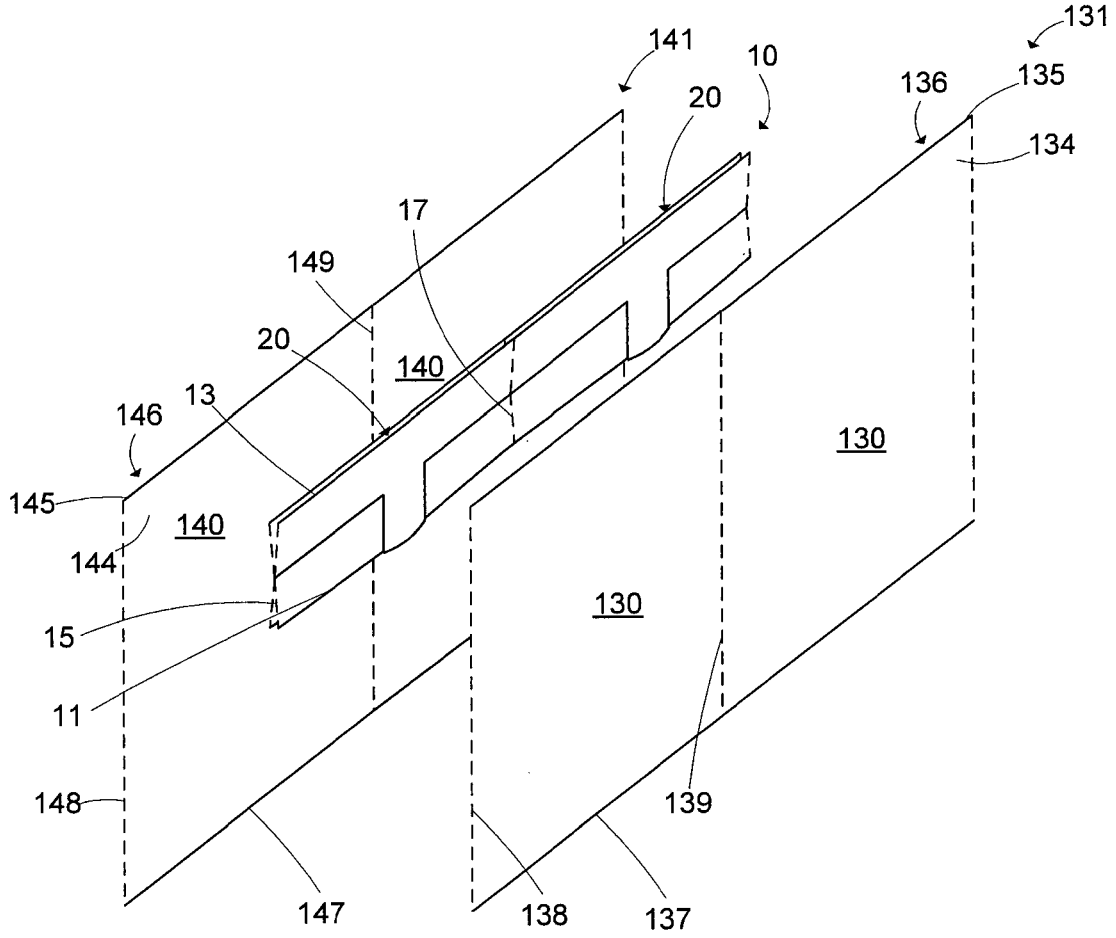
FIG. 9 is a perspective view of a combined web of valve material being introduced between the first and second webs of bag material according to a fourth stage of the embodiment of FIG. 8.

FIG. 9 illustrates the valve strip 10 being introduced between the first and second webs 131, 141 of bag material, such that they are conveyed in parallel, showing two valve strip portions 20 between two pairs of first and second bag sections 130, 140. In this embodiment, the top side 15 of each valve strip portion 20 is aligned with the top sides 138, 148 of each bag sections 30, 40; the bottom side 17 of each valve strip portion 20 is aligned with the bottom sides 139, 149 of the each bag section 130, 140; the open side 13 of each valve strip portion 20 is directed towards the valve sides 135, 145 of each bag section 130, 140; and the valve side 11 of each valve strip portion 20 is directed towards the open sides 137, 147 of each bag section 130, 140.

Figure 10:
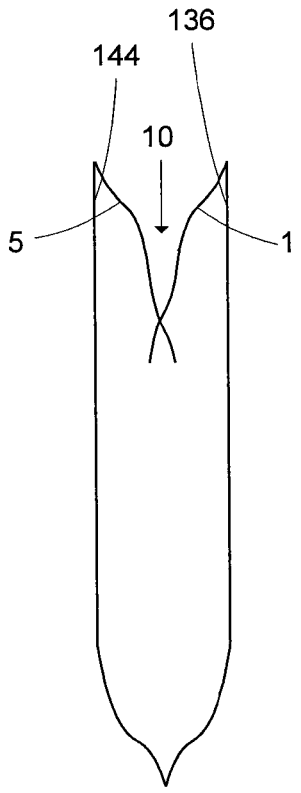
FIG. 10 is a side view of the combined web of valve material and the first and second webs of bag material, having been in-line sealed thereto according to a fifth stage of the embodiment of FIG. 8.

As shown in FIG. 10, the first web 1 of the plastic film 10 is then brought into contact with the lower side 136 of the first web 131 of bag material, and the second web 5 of the plastic film 10 is brought into contact with the upper side 144 of the second web 141 of bag material, and is sealed thereto at the top side 15, 138, 148 and bottom side 17, 139, 149. Furthermore, in this embodiment, the upper side 144 of the second web 141 of bag material is brought into contact with the lower side 136 of the first web 131 of bag material, and is sealed thereto at the top sides 138, 148 and bottom sides 139, 149. This process is called in-line edge sealing, and creates the combined web 150 of valve bag material.

Figure 11:
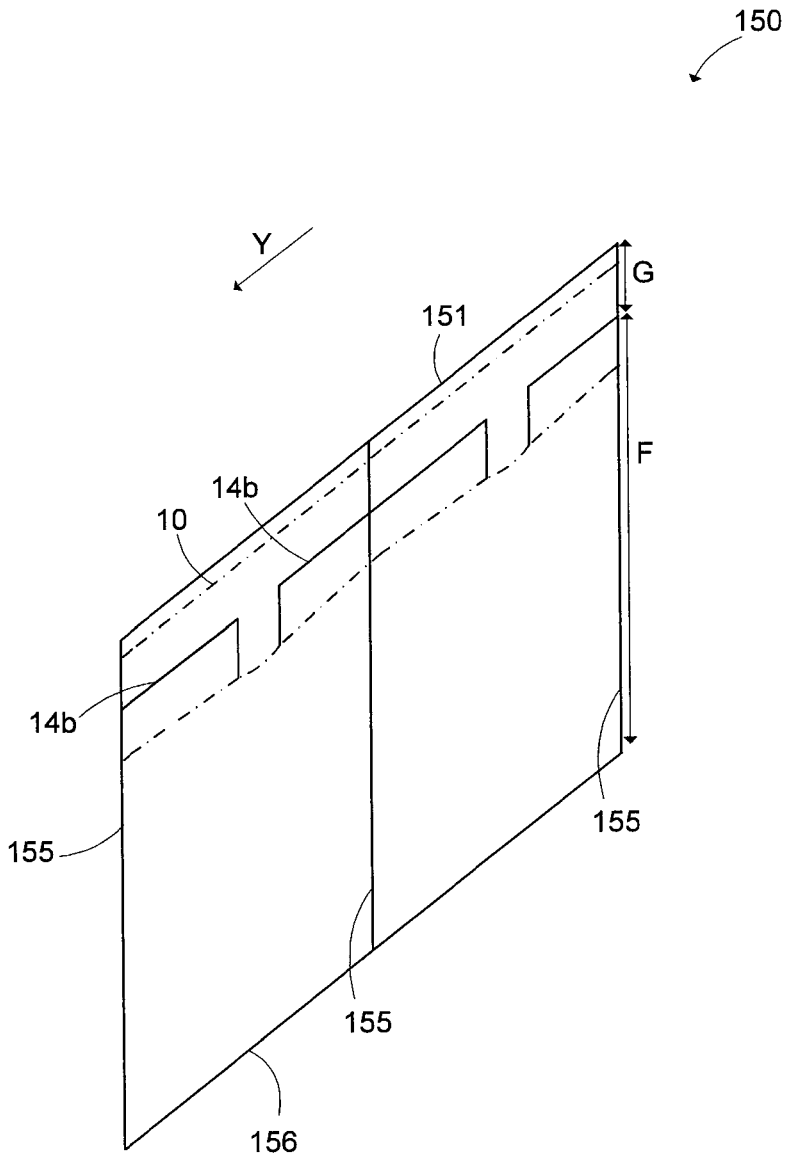
FIG. 11 is a perspective view of the combined web of valve bag material, having been cross-sealed according to a sixth stage of the embodiment of FIG. 8.

As shown in FIG. 11, the combined web 150 of valve bag material is conveyed along direction 'Y' and passes through a cross-sealing machine (not shown). The cross-sealing machine applies a perpendicular sealing line 155 along the minor axis of the combined web of valve bag material (i.e. perpendicular to direction 'Y'), along the top and bottom side 15, 17 of the valve strip 10 and the top side 138, 148 and the bottom sides 139, 149 of the bag sections 130, 140.

In this embodiment, a sealing machine applies a parallel sealing line 156 along a major axis of the combined web of valve bag material (i.e. parallel to direction 'Y'). Thus, the valve strip 10 is sealed to the first and second webs of bag material, forming bag portions along its length. The skilled reader will understand that the sealing machine may apply the parallel sealing line 156 before or after the cross-sealer.

The bag portions may then be separated by a cutting machine (not shown).

The skilled reader will understand that a single manufacturer may implement all of the above stages of manufacture. Therefore, the production line for the first and second stage of manufacture (which produces the valve strip), may feed into the fourth stage of production, such that the valve strip is introduced between the first and second bag sections before they are combined.

Alternatively, one manufacturer may produce valve strips, by implementing the first and second stages of production, and a second manufacturer may acquire such a valve strip for introduction into their production line. For example, the second manufacturer may modify his production line such that the valve strip is dispensed between the first and second bag sections before the first and second bag sections are combined. Thus the second manufacturer may implement only the third, fourth and fifth stages of production in their production line, by a simple introduction of the valve strip.

The skilled reader will understand that by positioning the valve strip 10 such that the sealing lines 14 (and therefore the valve portion 16) are a distance 'G' (see FIGS. 7 and 11) away from the edge of the valve sides 35, 45, 135, 145 of each bag section 30, 40, 130, 140 a gusset may be formed in the valve side of the combined web 50, 150 of valve bag material. Although the gusset is not essential, it helps a user find the opening of the valve 16 and strengthens the valve side 51, 151.

Figure 12:
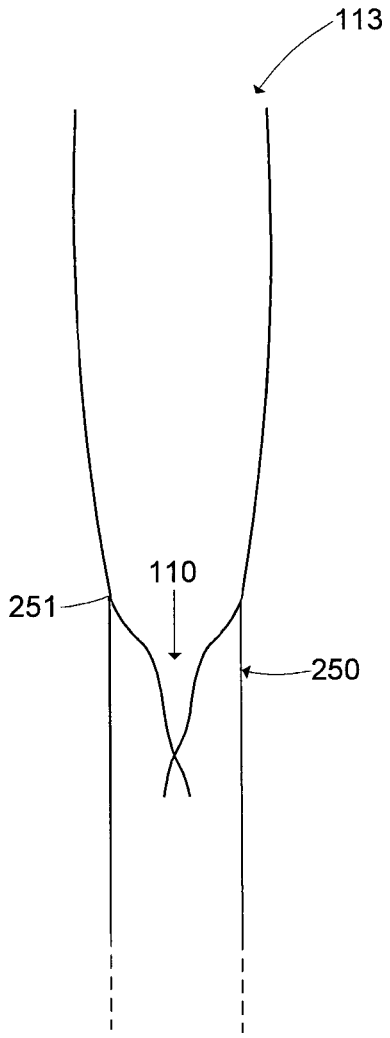
FIG. 12 shows a contemplated embodiment as disclosed herein.

A third contemplated embodiment will now be described with reference to FIGS. 12 and 13. In this embodiment, the length A of the valve strip 110 is relatively large compared to the previous embodiments to produce an extended valve strip 110. That is, the distance between the parallel portion 114*b* of the sealing line 114 and the open side 113 of the valve strip 110 is such that, when the valve strip 110 is attached to bag material to produce a valve bag 250, the open side 113 of the extended valve strip 110 extends out of the valve side 251 of the valve bag 250.

The valve bag 250 including the extended valve strip 110 has particular uses in flower packaging. That is, the interior of the valve bag 250 may be filled with nutrient rich water (which may not escape due to the self-sealing nature of the valve bag 250), and stems of a bunch of flowers may be introduced through the valve 116 into the water. In such an arrangement, the flowers are kept healthy as the stems are submerged in the trapped water, and the delicate flowers are protected by the portion of the valve strip 110 extending out of the valve bag 250.

Figure 13:
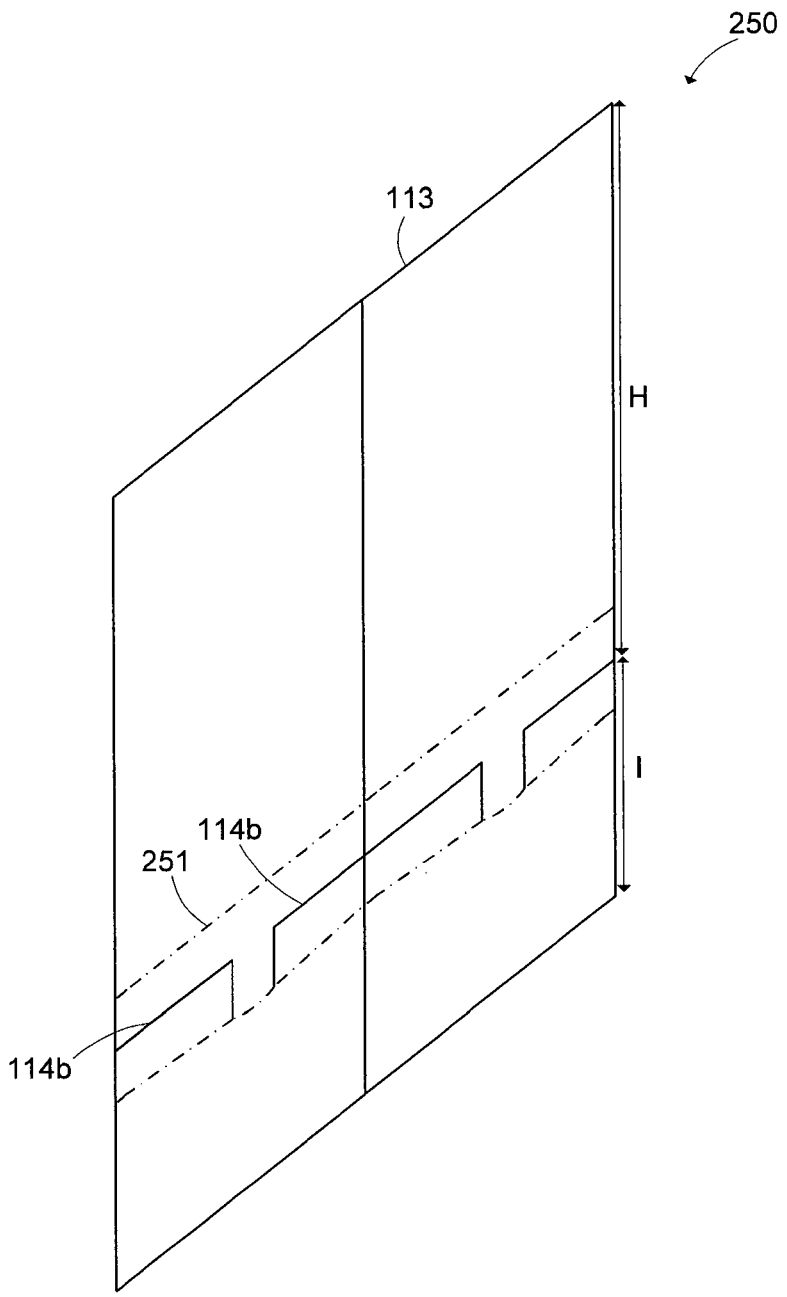
FIG. 13 shows a contemplated embodiment as disclosed herein.

The skilled reader will understand that, in the third embodiment, the distance between the sealing line 114 and the open side 113 of the extended valve strip 110 (distance H in FIG. 13) is relatively larger than the distance between the sealing line 114 and the bottom of each valve bag 250 (distance I in FIG. 13).

Figure 14:
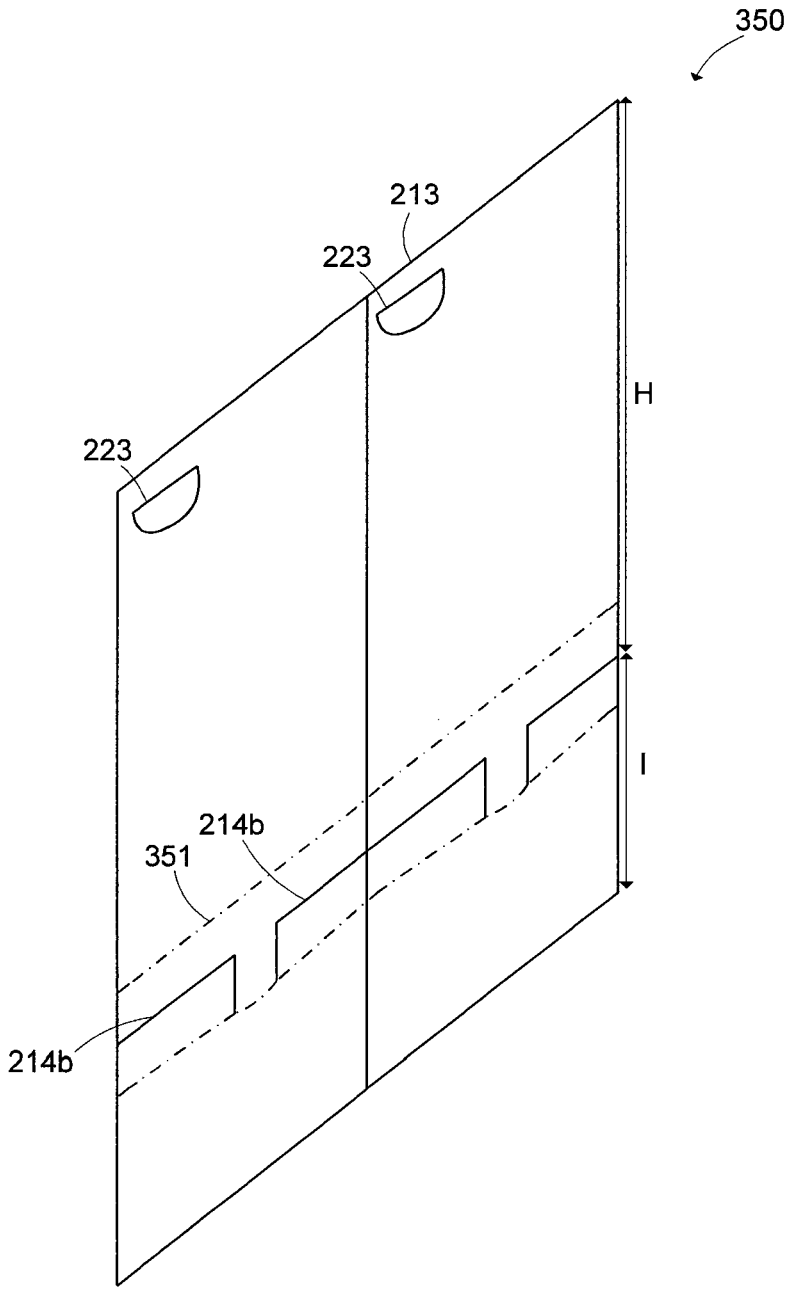
FIG. 14 shows a contemplated embodiment as disclosed herein.
Figure 15:
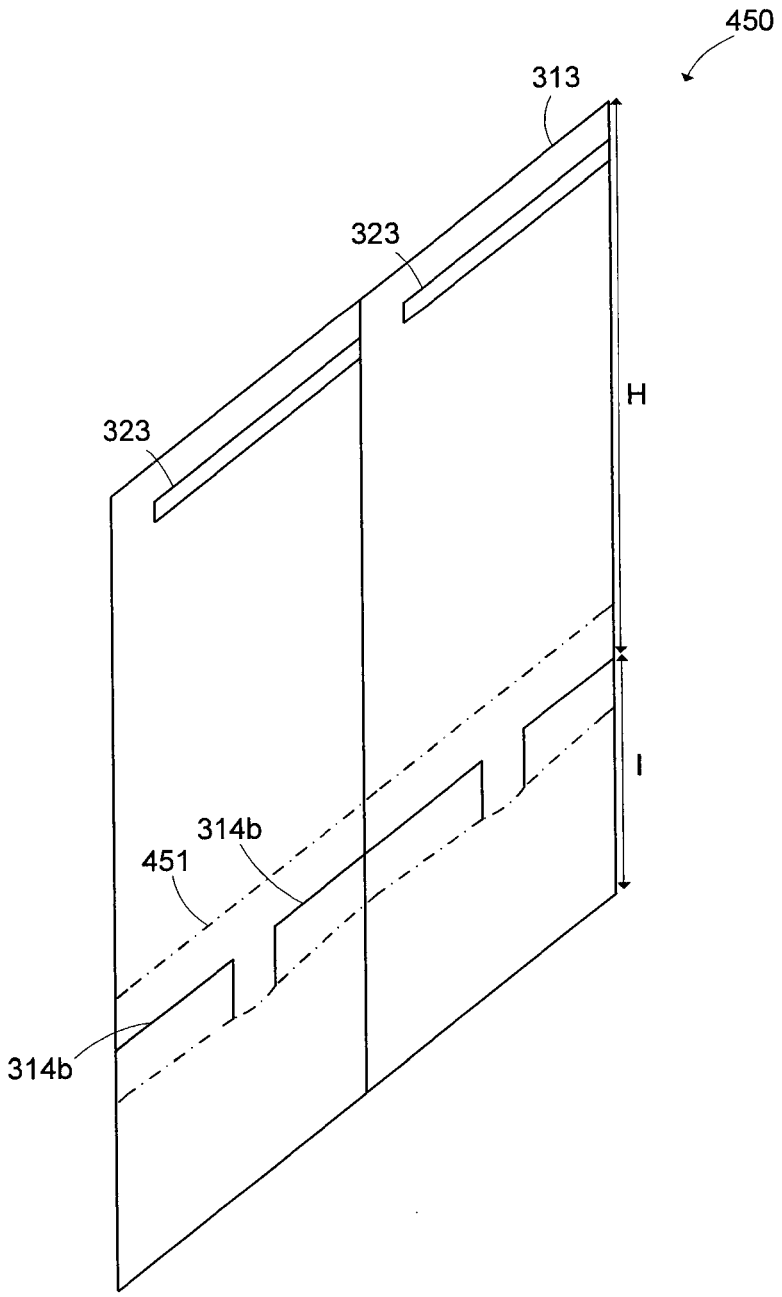
FIG. 15 shows a contemplated embodiment as disclosed herein.

In another arrangement (as shown in FIG. 14) the extended valve strip 210 may include a handle portion 223 in the extended portion of the valve strip 210. This helps the user carry the valve bag 350. In a further arrangement (as shown in FIG. 15), the extended valve strip 310 includes a garter 323 that may be tied around the stem of the bunch of flowers. This helps secure the valve bag 450 to the flowers.

The skilled person will understand that the extended valve strip of the third embodiment may be used to produce valve bags using the method of either the first or second contemplated embodiments.

In the above embodiments, the valve material and bag material are made of heat sealable plastic films. However, any suitable material may be used and the valve and materials may be different. The skilled reader will understand that the valve material and bag material may initially be part of the same web, which is separated to form the valve and bag materials. Furthermore, the same initial web may be separated on part of the production line, such that the valve material and bag material are conveyed in parallel, and the valve material may then be converted into a valve strip and introduced between the webs of bag material.

Furthermore, in the above embodiments, the materials may be dispensed in any form known in the art, for example, they may be unrolled from a roll of material, or may be extruded.

The skilled person will also understand that the process of in-line edge sealing is not essential. Rather, the step may be omitted and the cross sealer seals the valve strip to the web of folded bag material or to the first and second webs of bag material.

The skilled person will understand that any combination of features is possible without departing from the scope of the described subject matter, as claimed.

The invention claimed is:

1. A method of forming a valve bag comprising the steps of:

dispensing a first web of valve material and a second web of valve material, the first web of valve material and a second web of valve material both having an upper side and a lower side, the first web of valve material and the second web of valve material being plastic film;

creating a combined web of valve material by contacting the lower side of the first web of valve material with the upper side of the second web of valve material, the combined web of valve material being formed of a plurality of valve strip portions;

applying a sealing process to the combined web of valve material such that the first web of valve material is sealed to the second web of valve material, the sealing process defining at least one valve portion in each valve strip portion;

introducing the combined web of valve material between a first bag section and a second bag section, the first and second bag sections each having an upper side and a lower side;

creating a combined web of valve bag material, by contacting the lower side of the first bag section with the upper side of the first web of valve material, and by contacting the upper side of the second bag section with the lower side of the second web of valve material, the combined web of valve bag material being formed of a plurality of valve bag sections, each containing a valve strip portion;

applying a sealing process to the combined web of valve bag material such that the first bag section is sealed to the first web of valve material and the second bag section is sealed to the second web of valve material, the sealing process defining each valve bag section; and separating adjacent valve bag sections into individual valve bags.

2. The method of claim 1, wherein each of the first bag section and the second bag section has a first side and a second side, wherein the step of applying a sealing process to the combined web of valve bag material includes an initial step of in-line edge sealing the upper side of the first web of valve material to the lower side of the first bag section and in-line edge sealing the lower side of the second web of valve material to the upper side of the second bag section, along the first and second sides thereof, and a subsequent step of cross-sealing the combined web of valve bag material.

3. The method of claim 1, wherein the first bag section and the second bag section are part of a web of folded bag material, wherein the combined web of valve material is introduced at a header end of the web of folded bag material.

4. The method of claim 2, wherein the first bag section and the second bag section are part of a web of folded bag material, wherein the combined web of valve material is introduced at a header end of the web of folded bag material.

5. The method of claim 1, wherein the first bag section and the second bag section are part of a first web of bag material and a second web of bag material respectively, wherein the combined web of valve material is introduced at a header end of the first and second webs of bag material.

6. The method of claim 2, wherein the first bag section and the second bag section are part of a first web of bag material and a second web of bag material respectively, wherein the combined web of valve material is introduced at a header end of the first and second webs of bag material.

7. The method of claim 5, wherein the step of applying a sealing process to the combined web of valve bag material includes sealing along a footer end of the first and second webs of valve material.

8. The method of claim 3, wherein the combined web of valve material extends out of the header end of the folded bag material.

9. The method of claim 5, wherein the combined web of valve material extends out of the header end of the folded bag material.

10. The method of claim 1, wherein the valve material is different than the valve bag material.

11. The method of claim 1, wherein the valve material and valve bag material are part of a same initial web, the method comprising an initial step of separating the valve material from the valve bag material.

12. The method of claim 11, wherein the webs of valve material and the webs of bag material are conveyed in parallel, such that the combined web of valve material is created and introduced between the first bag section and the second bag section.

* * * * *